US006161250A

United States Patent [19]

Young et al.

[11] Patent Number: 6,161,250

[45] Date of Patent: Dec. 19, 2000

[54] DUSTLESS REGENERATIVE AIR SWEEPER

[75] Inventors: Gary B. Young; Joseph Dvorsky, both of Waco, Tex.

[73] Assignee: Tymco, Inc., Waco, Tex.

[21] Appl. No.: 09/374,109

[22] Filed: Aug. 16, 1999

[51] Int. Cl.[7] ..... E01H 1/08

[52] U.S. Cl. ..... 15/346; 15/340.4

[58] Field of Search ..... 15/340.3, 340.4, 15/346

[56] References Cited

U.S. PATENT DOCUMENTS

| | | | |
|---|---|---|---|
| 1,071,301 | 8/1913 | Diserens . | |
| 1,207,816 | 12/1916 | Thompson . | |
| 1,459,968 | 6/1923 | Bailly . | |
| 3,512,206 | 5/1970 | Young . | |
| 3,545,181 | 12/1970 | Young . | |
| 3,755,851 | 9/1973 | Williams | 15/346 |
| 3,870,489 | 3/1975 | Shaddock . | |
| 4,006,511 | 2/1977 | Larsen . | |
| 4,007,026 | 2/1977 | Groh . | |
| 4,206,530 | 6/1980 | Kroll et al. . | |
| 4,310,944 | 1/1982 | Kroll et al. . | |
| 4,457,043 | 7/1984 | Oeberg et al. . | |
| 4,570,287 | 2/1986 | Kerschner et al. . | |
| 4,660,248 | 4/1987 | Young | 15/346 X |
| 4,885,817 | 12/1989 | Tanase . | |

OTHER PUBLICATIONS

Donaldson Bulletin #1200–344, copyright 1995.

Donaldson Torit Products—Partners in Grime, copyright 1996.

Barber Colman Company—Installation and Wiring, Apr.

Dwyer—Series 300 . . . .

*Primary Examiner*—Chris K. Moore

*Attorney, Agent, or Firm*—Diller, Ramik & Wight, PC

[57] ABSTRACT

A closed-loop Regenerative® air sweeper is provided which constitutes an improvement of that disclosed in U.S. Pat. No. 3,512,206. The sweeper of the latter patent is provided as an integral portion thereof, whereas a conversion, a "dustless" mechanism having first and second chambers into the first chamber of which is directed a portion of the air stream from a pressure conduit associated with a pickup head of the sweeper. Particles of debris are separated by cyclone separators and thereafter by membrane filters after which substantially clean air is discharged to atmosphere. Air entrained particles separated by the cyclone separators and the cartridge filters are returned to a vacuum side of the pickup head thereby maintaining substantially closed-loop air flow of the sweeper. Clean air is controllably exhausted to atmosphere by flue vanes which can be selectively moved under pressure differential sensing means associated with the cyclone separator. The pressure in the two air chambers is also sensed with the read-out thereof being in an instrument panel to permit an operator to monitor and diagnose the system. Pulses of high pressure air are utilized to clean the membrane filter and a pop-off valve serves as an emergency vent to atmosphere under undesired high pressure within the second chamber of the housing. An extremely important aspect of the present invention is that achieved by creating and maintaining a substantially negative pressure at and across the pickup head. The latter is achieved by assuring that the air drawn into the pickup head is approximately a nominal ten percent (10%) and the clean air discharged to atmosphere is maintained at the substantially the same nominal ten percent (10%) through appropriately operating a valve under the control of a pressure differential sensor which measures pressure drop across the cyclone separators.

78 Claims, 2 Drawing Sheets

SCB
CS
B
10
12
13
13
Ps
Pss
32
PF
40
AF
AF
AF
P
91
80
22
45
Ss
70
50
51
90
36
55
65
Sc
35
66
Sc
27
20
51
50
51
56
Pss
21
29
41
40
67
24
75
42
23
53
25
Ps
28
Sc
54
30
43
Pss
Ps
40
45

DUSTLESS REGENERATIVE AIR SWEEPER

BACKGROUND OF THE INVENTION

The closed-loop Regenerative® air system was invented more than twenty-five (25) years ago by Mr. Bernard W. Young, as is evidenced by U.S. Pat. Nos. 3,512,206 and 3,545,181 granted on May 19 and Dec. 8, 1970, respectively. Tymco, Inc. of Waco, Tex. has manufactured closed-loop Regenerative® air sweepers for more than twenty-five years, and each uses the force of a high velocity controlled jet of air created by a powerful blower to blast down and across a pickup head onto pavement and into cracks thereof forcing up into the air stream of the pickup head packed-on heavy debris and fine dust particles. The debris-laden air stream is pulled into a large hopper where the air loses velocity and larger debris falls to the bottom. A screen at the top of the hopper prevents items, such as leaves, paper, cans, rocks and large pieces of debris from leaving the hopper and entering a centrifugal dust separator. The centrifugal dust separator spins the air along a curved wall of a centrifugal separator chamber until small size dust particles are skimmed off into the hopper and substantially clean air is returned to the blower to continue the closed-loop air cycle of the Regenerative® air sweeper. This closed loop system substantially prevents dirty air from being undesirably exhausted into the environment.

Such Tymco Regenerative® air sweepers are highly efficient under dry conditions and are also relative efficient even under rainy or wet conditions. Mechanical sweepers utilizing brooms and vacuum sweepers utilizing both brooms and vacuums tend to clog and/or smear while the Regenerative® air sweeper continues to efficiently clean under such rainy or wet conditions which means cleaning schedules can be accurately maintained and fulfilled.

While such Regenerative® air sweepers have performed admirably over the years and were originally intended for use in hazardous environments, applications have grown to include virtually all dustless operations in such environments as tunnels, building interiors and most any other uses where water for dust suppression is not an option (cement plants, freezing climates, etc.) The Environmental Protection Agency (EPA) has also expanded its restrictions concerning dustless operation and a need has arisen for a truly substantially "dustless" Regenerative® air sweeper.

A truly substantially "dustless" Regenerative® air sweeper has become highly desirable due to more stringent requirements of the EPA, and sensitivities involved in substantially dustless operation in such environments as noted immediately heretofore, particularly should dust be laden with water and/or moisture.

Several efforts have been made toward achieving dustless debris collection, as is evidenced by U.S. Pat. Nos. 4,870,489; 4,006,511 and 4,457,043 issued respectively on Mar. 11, 1975; Feb. 8, 1977 and Jul. 3, 1984. Each of these patents discloses a sweeping machine which desirably seeks to prevent dust-entrained air from being exhausted to atmosphere. For example, in U.S. Pat. No. 4,457,043 air is drawn from a main mouthpiece through a suction pipe into a coarse separator arranged in front of a cyclone separator with air being recycled through a fan and another conduit to the main mouthpiece. A portion of the air stream from the fan is diverted to another separator through which air is exhausted by a separate fan. The latter prevents the overall system from being truly "closed" because a substantial portion of the air and any entrained debris beyond the separator is evacuated into atmosphere by the associated evacuation fan. A similar auxiliary blower associated with the mobile street sweeper of U.S. Pat. No. 4,006,511 prevents the system from being essentially "closed." However, these and other similar patents, such as U.S. Pat. No. 3,870,489, reflect common usage of bag house filtering units and/or cyclone filtering units associated with street sweepers, though none in association with a Regenerative® air sweeper which maintains substantially 100 percent air flow through its closed-loop air system absent debris being forcefully or otherwise exhausted to atmosphere.

SUMMARY OF THE INVENTION

In keeping with the foregoing, a novel, "dustless" Regenerative® air sweeper is provided which essentially maintains the closed-loop air system of such Tymco manufactured street sweepers, while at the same time providing maximum filtration under both dry and wet conditions absent any substantial air loss and absent debris-laden air exhaust to atmosphere. The "dustless" Regenerative® air sweeper preferably includes the conventional components of Tymco's closed-loop Regenerative® air sweepers, such as a high velocity fan or blower, a high pressure conduit for delivering high pressure air to an inlet of a pickup head along which the air flows to achieve optimum pickup, an outlet conduit from the pickup head for delivering debris to a main hopper, a filter in the main hopper for segregating relative large debris from an air stream, and a centrifugal filter for separating smaller debris from the air stream followed by the return of the air stream to the fan and the continuation of the closed-loop air flow. However, either as a conversion to such a conventional Regenerative® air sweeper or as an integral unit, the "dustless" Regenerative® air sweeper of the present invention includes a transfer tube or conduit which delivers a portion of the debris-laden air stream from the pressure conduit to a small particle separator which in turn delivers still smaller particle-ladened air to dust filters from which clean air flows and is exhausted to atmosphere. The small particle separator delivers small particles entrained in an air stream to the suction or vacuum side of the sweeper, while the smallest filtered particles are also returned to the suction side or vacuum conduit for eventual separation by the main centrifugal dust separator. Since the system is entirely substantially "closed," the only air exhausted is clean air exiting the filters.

In further accordance with the invention, the filters are pulsed-cleaned automatically and relatively rapidly to assure that all small particles/dust are substantially cleaned from filtering surfaces of the filters which inherently assures that only clean air will be exhausted to atmosphere.

The small particle separator is also bridged by a pressure-differential sensor to control associated flue plates or vanes downstream of the filters to assure that a constant volume of clean air is exhausted to atmosphere.

The entire system is preferably encased in a housing, and at any over-pressure downstream of the filters, a pop-up valve will automatically move to an open position thereby preventing dirt-laden air from exhausting to atmosphere, damaging the housing, and/or components within the housing.

Finally, another pressure differential gauge is provided in the air stream bridging a filtering manifold or chamber and a clean air manifold or chamber with a read-out therefrom being located in the cab of the vehicle which allows continued operator surveillance and manual shut-down of the system should such be found necessary.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figure 1:
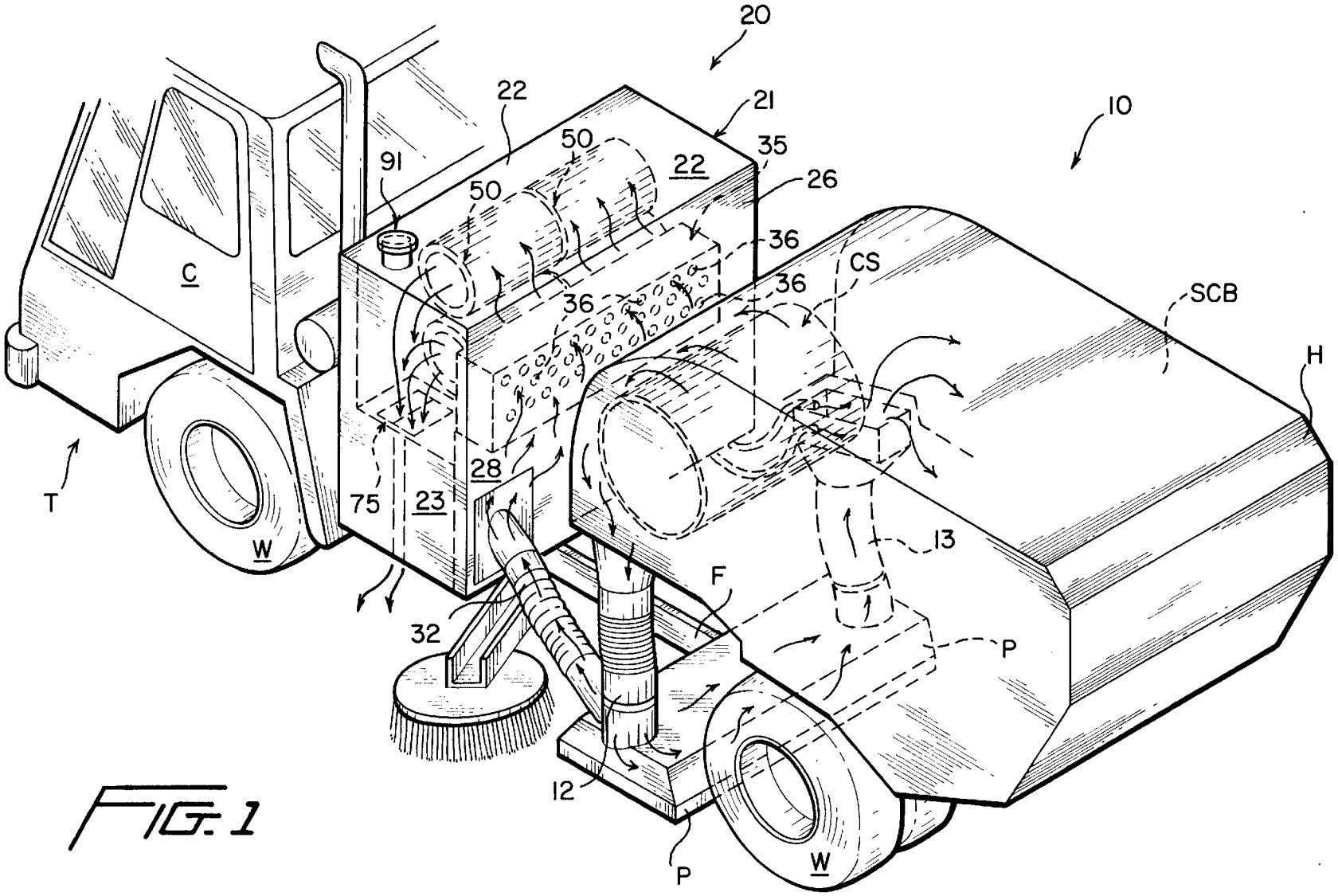
FIG. 1 is a fragmentary perspective schematic view of a novel "dustless" Regenerative® air sweeper constructed in accordance with this invention, and illustrates a vehicle having a main hopper and therebeneath a pickup head substantially as described earlier herein with a conduit for transporting air entrained particulate material from an air inlet of the pickup head into a housing having several cyclone separators followed by tubular fabric filters from the latter of which clean air is exhausted to atmosphere through automatically controlled flue plates or vanes.
Figure 2:
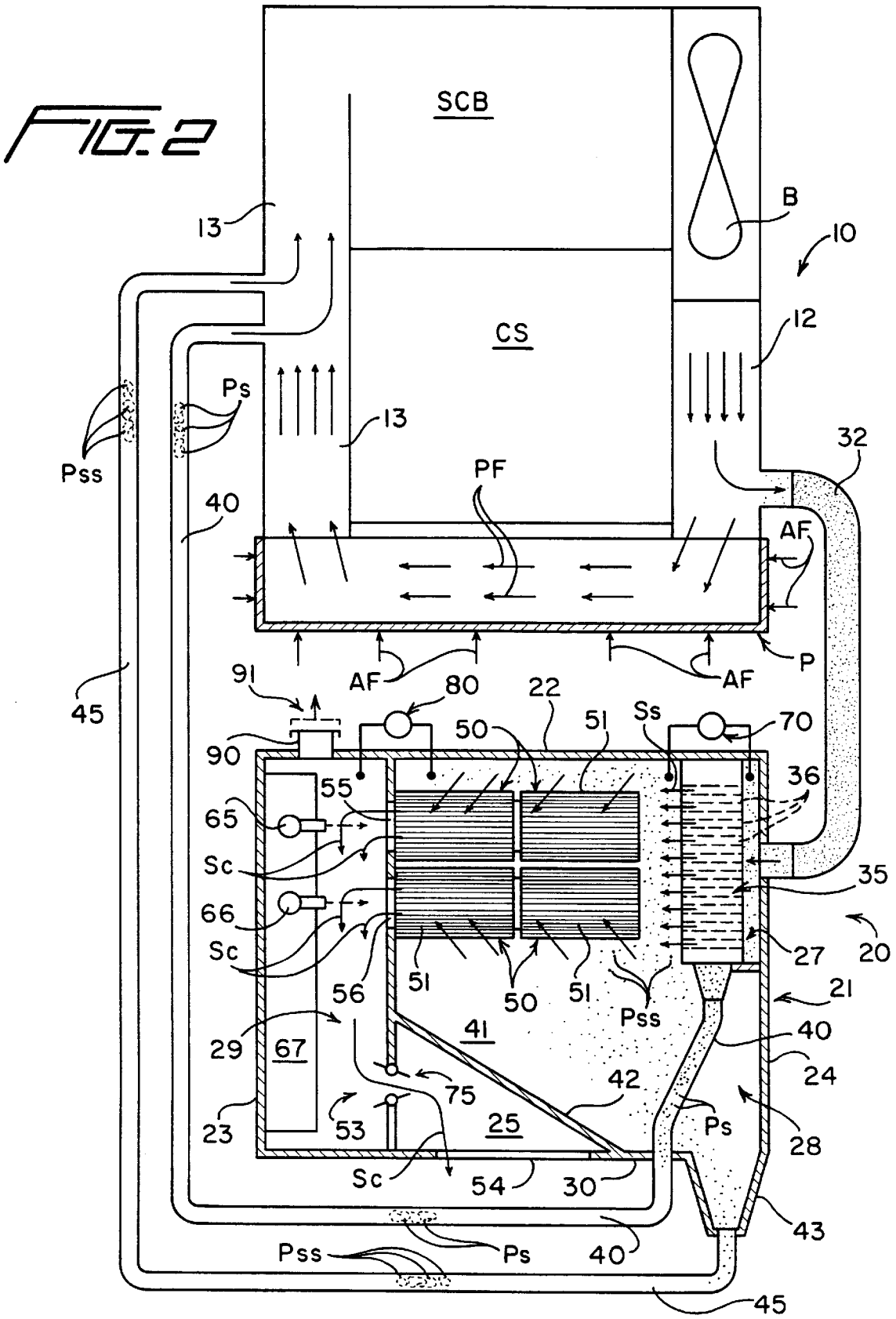
FIG. 2 is schematic view of the "dustless" Regenerative® air sweeper of FIG. 1, and illustrates two other conduits for transporting air entrained particulate material from the cyclone separators and the tubular fabric filters to the suction or vacuum side of the main hopper to maintain the overall closed-loop air flows of the sweeper.

A novel "dustless" Regenerative® air sweeper of the present invention is fully illustrated in FIGS. 1 and 2 of the drawings and is generally designated by the reference numeral 10.

The sweeper 10 corresponds substantially to that disclosed in U.S. Pat. No. 3,512,206 granted on May 19, 1970, and most of the specifics thereof are incorporated hereat by reference, including a truck T having wheels W and a frame F supporting a housing H which defines an inner solids collection bin SCB. A pickup head P is floatingly suspended from the frame F and extends transversely to the direction of the path of cleaning movement of the truck T over and adjacent to the surface to be cleaned.

A fan or blower B (FIG. 2) discharges air under pressure through a pressure duct or conduit 12 to the pickup head P which is so constructed that the air under pressure is delivered through orifice means in a forceful flow downwardly against the surface to be cleaned under the pickup head and flows over that surface both parallel to the direction of cleaning and transverse to that direction while drawing a small amount, i.e. ten percent (10%) of air from atmosphere into the pickup head, as indicated by the air flow arrows AF. The parallel air flow PF through the pickup head P is finally discharged from the pickup head through a suction or vacuum duct or conduit 13 which delivers air-entrained solids or particulate material to the solids collection bin SCB. The air-entrained particulate stream reaches the large volume solids collection bin SCB expands, slows down, so to speak, and thereby permits a major portion of the heavier/larger entrained solids to drop to the bottom of the bin SCB. The air, still containing somewhat smaller entrained solids, passes through a generally horizontally disposed grate-like filter (not shown) which separates still smaller entrained solids from the air flow, and the latter is thereafter delivered tangentially into a centrifugal separator CS which spins die air and entrained particulate material/dust along a curved wall thereof with particles being discharged into the solids collection bin SCB and relatively clean air being returned to the blower B to continue the Regenerative® air flow in a continuous closed-loop stream.

As thus far described, the sweeper 10 operates in accordance with the more specific description set forth in U.S. Pat. No. 3,512,206.

In accordance with the present invention, the sweeper 10 includes as an integral part thereof or a conversion, a "dustless" mechanism 20 associated with the surface sweeping machine 10 which particularly adapts the latter for sweeping particulate material under both wet and dry conditions.

The mechanism 20 includes a housing 21 located adjacent a cab C carried by the frame F of the sweeper 10 which is defined by a top wall 22, side walls 23, 24 (FIG. 2), a front wall 25 (FIG. 2), a rear wall 26 and a bottom wall 30.

Conduit means 32 in the form of a conduit, pipe or duct is connected between the pressure conduit 12 and a housing 27 located in a first chamber or housing portion 28 of the housing 21 and conducts or transports a portion of the air-entrained particulate material from the conduit 12 into the housing 27 immediately adjacent to the wall 24 and a bank of vertically disposed filter means or separator means 35 housed in the housing 27. The filter means or separator means 35 are Strata® panel inertial separators each in the form of an individual tube 36 having substantially horizontally disposed axes (FIG. 1). Thus, the separator 35 is essentially a conventional Strata® panel made up of many individual Strata® tubes 36 with each tube containing specially designed vanes that induce a spinning motion to the stream of air entrained particulate material which causes the particles to be thrown against outer walls (unnumbered) of each tube 36 and removed with a scavenge air flow by way of a first air stream which discharges small particles into conduit means 40 in the form of a duct, pipe or conduit while still smaller particles axially exit the tubes 36 in a stream Ss. Thus, small particles Ps exit the cyclone separators 35 through the conduit 40, while still smaller particles Pss pass through the cyclone separators or tubes 36 entrained in the air streams Ss with the still smaller air particles Pss dropping downwardly into a hopper portion 41 of the first chamber 28 which includes a tapered wall 42 and a conical discharge 43 in fluid communication with further conduit means 45 in the form of a conduit, pipe or duct. The conduits 40 and 45 are connected to the vacuum or suction conduit 13 (FIG. 2) and the respective particles Ps and Pss are drawn therethrough into and maintain intact the closed-loop air stream.

The Strata® panel separator 35 and the individual Strata® cyclone separators are preferably of the type manufactured by Donaldson of P.O. Box 1299, Minneapolis, Minn. 55440 and the specifics thereof are found in Donaldson Bulletin #1020-0344 which is incorporated hereat by reference. The efficiencies of such cyclone separators 35 are extremely high, particularly in the 0.5 to 7 micron size particle range. Further details of the construction of individual cyclone separators collectively identified as Strata® Tube separators or cyclone separators 35 can be found in U.S. Pat. No. 4,746,340. Additionally, though a single bank or tube panel 35 is illustrated in FIGS. 1 and 2, several such banks can be utilized with larger or smaller tubes in substantially aligned relationship depending upon the particular cfm/sq. ft. involved and the size particles which are to be scavenged from the air stream conducted through the conduit 32. The cyclone separators 35 are extremely efficient, not only under dry conditions, but particularly under wet conditions and tend to avoid clogging or compacting which would otherwise decrease overall particle separation efficiencies.

A plurality of filter means or separator means 50 are also located in the housing portion or chamber 28 downstream of the filter means or separator means 35, and each filter means 50 is a so-called Torit-Tex™ cartridge which is essentially tubular and is primarily defined by an exterior cylindrical smooth hydrophobic PTFE membrane 51 which provides exceptional filtration efficiency (99.999% on 0.5 micron particles). Thus, virtually all such particles impinging against the membrane 51 are prevented from passing therethrough and substantially clean air axially exits the cartridge filters 50 along individual air streams Sc of substantially clean air which enter the housing chamber or portion 29 and exit the latter through a passage 53 which in turn exhausts to atmosphere through an opening 54 in the lower wall 30 of the housing 21. Each Torit-Tex™ filter 50 is also manufactured by Donaldson, supra, and the exact specifications of the desired Torit-Tex™ filters 50 utilized in conjunction with this invention are those set forth in Form Torit-Tex™ 4/96 entitled "PARTNERS in GRIME" of Donaldson. The PTFE membrane 51 of each of the cartridge filters 50 is particularly advantageous because the thousands of microscopic fibers thereof capture dust particles on the exterior surface of the medium. The smooth hydrophobic exterior surface of each filter 50 easily releases moist, hygroscopic and agglomerative particles, particularly damp or wet particles, particularly under expansion and flexing of the filter media 51 under high pressure air pulse cleaning, as will be described more filly hereinafter. Such filter media or membranes 51 can also be washed and reused repeatedly, dry quickly, and each can be returned to service immediately thereafter.

As is best illustrated in FIG. 2 of the drawings, two aligned pairs of filters 50 are illustrated and the air streams Sc exit therefrom through openings 55, 56, each having an axis in alignment with air jets 65, 66, respectively, of a pressurized air manifold 67 located in the housing portion or chamber 29. A conventional compressor (not shown) supplies the manifold 68 with compressed air and an appropriate conventional timing circuit opens valves (not shown) associated with the nozzles 65, 66 at desired time intervals (every 15 seconds, for example) to blast high pressure air through the openings 55, 56 and into the interiors of the filter cartridges 50 causing the filter membranes 51 to flex or bulge outwardly. The high pressure internal air and the flexing of the membranes 51 discharges particles from the exterior surfaces of the membranes 51 and these particles also descend downwardly into the conical discharge 43 and are eventually conveyed by the conduit 45 to the suction conduit 13 (FIG. 2).

Sensing means 70 (FIG. 2) are provided to sense pressure and preferably pressure differential across the cyclone separators 35 to maintain efficient particle separation by automatically controlling the discharge of clean air Sc through the passage 53 by varying the size thereof through movable flue plates or valves 75 operative through a conventional servo-motor or an electric actuator responsive to the output of the sensing means 70, such as Series EA Electric Actuators manufactured by Barber Colman Company, the specifics of which are disclosed in Bulletin No. 1321/IN 3-11 of April 1989 entitled "Installation and Wiring." The sensing means 70 is preferably a Photohelic sensor/switch/gauge manufactured and sold by Dwyer Instruments, Inc. of P.O. Box 373, Michigan City, Ind. 46361, preferably the Series 3000 thereof. These switches/gauges 70 function as highly repeatable pressure switches combined with a precise pressure gauge for measuring and controlling positive, negative or differential pressures and can be adjusted or set for control between high and low pressure set points. When pressure changes, reaching either set point pressure, a phototransistor signal is electronically amplified to actuate a slave relay which in turn operates the flue plates 75 to adjustably open or close, partially or fully, the latter to regulate the discharge of clean air Sc to the atmosphere, thus automatically regulating the total air flow exiting the pressure conduit 12 into the conduit 32 and exiting the conduits 40, 45 into the suction conduit 13. By thus regulating the air flow, the system assures that only substantially clean air Sc exits the chamber 29 to atmosphere, and such occurs automatically while continually maintaining the entire substantially closed-loop air flow of the system.

Further sensing means 80 substantially identical to the sensing means 70 are provided to measure the pressure differential in and/or across the chambers 28 and 29. The output of the sensing means 80 is read-out from an instrument panel of the vehicle so that an operator can visually ascertain the operating efficiencies of the system and intervene should he diagnose problems.

Finally, as an emergency precaution, the chamber 29 includes a cylindrical exhaust stem carrying a conventional automatic pressure pop-off valve 91 which in its closed position closes the chamber 29 to atmosphere through a tube 90 but can automatically open to the phantom outline position of the valve 91 under excessive pressure within the chamber 29.

The "dustless" Regenerative® air sweeper 10, including the "dustless" mechanism 20 thereof, assures high efficiency performance under all conditions, particularly under wet surface conditions, and most notably maintains a relatively closed-loop air stream throughout the entire system with only substantially clean air being eventually exhausted to atmosphere after separation/filtration thereof.

An extremely important aspect of the present invention is that achieved by creating and maintaining a substantially negative pressure at and across the pickup head P. The latter is achieved by assuring that the air AF drawn into the pickup head P is approximately a nominal ten percent (10%) and the air SC discharged through the opening 53 is maintained at substantially the same nominal ten percent (10%) through appropriately varying the valve 75 under the control of the sensor 70. Accordingly, since a slight negative or vacuum is maintained at the pickup head PF and no over-pressure occurs within the pickup head PF, the main air flow or the primary air flow PF of air in the pickup head P is not discharged to atmosphere, thus preventing "puffs" of air from being discharged to atmosphere along a lower periphery (not shown) of the pickup head P. Thus, in the area of the pickup head P the negative or vacuum pressure truly maintains "dustless" operating conditions. Obviously, though a nominal ten percent (10%) negative pressure has been mentioned herein, the same is merely exemplary and can vary within a range of perhaps substantially ten percent (10%)/fifteen (15%), again being controlled by the sensing means 70 and the adjustment of the opening 53 by the valve 75.

Although a preferred embodiment of the invention has been specifically illustrated and described herein, it is to be understood that minor variations may be made in the apparatus without departing from the spirit and scope of the intention, as defined the appended claims.

What is claimed is:

1. A surface sweeping machine particularly adapted for sweeping particulate material under wet or dry conditions comprising a pickup head along which an air stream travels from an air inlet to an air outlet, means for generating said air stream, a hopper, first conduit means for transporting air entrained particulate material from said air outlet to said hopper, second conduit means for transporting air entrained particulate material from said hopper to said air inlet, third conduit means for transporting a portion of the air entrained particulate material from the second conduit means to a small particle separator, said small particle separator including means for separating the air entrained particulate material portion into a small particle entrained first air stream and a smaller particle entrained second air stream, and means for filtering said smaller particle entrained second air stream to substantially filter therefrom the smaller particles and continuing substantially clean air flow along a third air stream.

2. The surface sweeping machine as defined in claim 1 including fourth conduit means for conducting said small particle entrained first air stream to said first conduit means.

3. The surface sweeping machine as defined in claim 2 wherein said separating means includes at least one cyclone separator.

4. The surface sweeping machine as defined in claim 2 including means for housing said small particle separator and said filtering means, and means for venting said housing means to atmosphere in response to excessive pressure in said housing means.

5. The surface sweeping machine as defined in claim 2 including means for sensing pressure drop across said small particle separator, and means responsive to said pressure drop sensing means for controlling the clean air flow to atmosphere.

6. The surface sweeping machine as defined in claim 2 including means for cleaning said filtering means, first chamber means housing said small particle separator and said filtering means, second chamber means housing said filtering cleaning means, said third air stream being conducted from said filtering means into said second chamber means, means for sensing air pressure drop across said small particle separator, and means responsive to said air pressure drop sensing means for controlling the clean air flow from said second chamber means to atmosphere.

7. The surface sweeping machine as defined in claim 1 including fourth conduit means for conducting said smaller particle entrained second air stream to said first conduit means.

8. The surface sweeping machine as defined in claim 7 wherein said separating means includes at least one cyclone separator.

9. The surface sweeping machine as defined in claim 7 including means for housing said small particle separator and said filtering means, and means for venting said housing means to atmosphere in response to excessive pressure in said housing means.

10. The surface sweeping machine as defined in claim 7 including means for sensing pressure drop across said small particle separator, and means responsive to said pressure drop sensing means for controlling the clean air flow to atmosphere.

11. The surface sweeping machine as defined in claim 7 including means for cleaning said filtering means, first chamber means housing said small particle separator and said filtering means, second chamber means housing said filtering cleaning means, said third air stream being conducted from said filtering means into said second chamber means, means for sensing air pressure drop across said small particle separator, and means responsive to said air pressure drop sensing means for controlling the clean air flow from said second chamber means to atmosphere.

12. The surface sweeping machine as defined in claim 1 including fourth conduit means for conducting said small particle entrained first air stream to said first conduit means, and fifth conduit means for conducting said smaller particle entrained second air stream to said first conduit means.

13. The surface sweeping machine as defined in claim 12 wherein said separating means includes at least one cyclone separator.

14. The surface sweeping machine as defined in claim 12 including means for housing said small particle separator and said filtering means, and means for venting said housing means to atmosphere in response to excessive pressure in said housing means.

15. The surface sweeping machine as defined in claim 12 including means for sensing pressure drop across said small particle separator, and means responsive to said pressure drop sensing means for controlling the clean air flow to atmosphere.

16. The surface sweeping machine as defined in claim 12 including means for cleaning said filtering means, first chamber means housing said small particle separator and said filtering means, second chamber means housing said filtering cleaning means, said third air stream being conducted from said filtering means into said second chamber means, means for sensing air pressure drop across said small particle separator, and means responsive to said air pressure drop sensing means for controlling the clean air flow from said second chamber means to atmosphere.

17. The surface sweeping machine as defined in claim 1 wherein said separating means includes at least one cyclone separator.

18. The surface sweeping machine as defined in claim 1 wherein said separating means includes a plurality of cyclone separators.

19. The surface sweeping machine as defined in claim 1 wherein said separating means includes a plurality of cyclone separators disposed in substantially axially parallel relationship to each other.

20. The surface sweeping machine as defined in claim 1 wherein said separating means includes a plurality of cyclone separators disposed in substantially vertically stacked, axially parallel relationship to each other.

21. The surface sweeping machine as defined in claim 1 including means for discharging said third air stream to atmosphere.

22. The surface sweeping machine as defined in claim 1 including large particle separator means in said hopper downstream of said air stream generating means for separating large particles from the air stream prior to the transport thereof by said second conduit means.

23. The surface sweeping machine as defined in claim 1 including means for cleaning said filtering means.

24. The surface sweeping machine as defined in claim 1 including means for cleaning said filtering means, and said cleaning means are located downstream of said filtering means.

25. The surface sweeping machine as defined in claim 1 wherein said filtering means includes at least one tubular filter medium through which the third air stream passes and to an outer surface of which adhere the smaller particles of the smaller particle entrained second air stream, and means for cleaning the at least one tubular filter medium by directing a blast of high pressure air into an interior thereof.

26. The surface sweeping machine as defined in claim 1 wherein said filtering means includes at least one tubular filter medium through which the third air stream passes and to an outer surface of which adhere the smaller particles of the smaller particle entrained second air stream, and means for cleaning the at least one tubular filter medium by directing a blast of high pressure air into an interior thereof in a direction opposing the direction of clean air flow.

27. The surface sweeping machine as defined in claim 1 wherein said filtering means includes at least one tubular filter medium through which the third air stream passes and to an outer surface of which adhere the smaller particles of the smaller particle entrained second air stream, and means for periodically cleaning the at least one tubular filter medium by directing a blast of high pressure air into an interior thereof.

28. The surface sweeping machine as defined in claim 1 including hopper means for collecting therein the smaller particles.

29. The surface sweeping machine as defined in claim 1 including means for housing said small particle separator and said filtering means, and means for venting said housing means to atmosphere in response to excessive pressure in said housing means.

30. The surface sweeping machine as defined in claim 1 including means for housing said small particle separator and said filtering means, means for venting said housing means to atmosphere in response to excessive pressure in said housing means, and said venting means is a pressure responsive valve.

31. The surface sweeping machine as defined in claim 1 including means for sensing pressure drop across said small particle separator, and means responsive to said pressure drop sensing means for controlling the clean air flow to atmosphere.

32. The surface sweeping machine as defined in claim 1 including means for cleaning said filtering means, first chamber means housing said small particle separator and said filtering means, second chamber means housing said filtering cleaning means, said third air stream being conducted from said filtering means into said second chamber means, means for sensing air pressure drop across said small particle separator, and means responsive to said air pressure drop sensing means for controlling the clean air flow from said second chamber means to atmosphere.

33. The surface sweeping machine as defined in claim 1 including means for cleaning said filtering means, first chamber means housing said small particle separator and said filtering means, second chamber means housing said filtering cleaning means, said third air stream being conducted from said filtering means into said second chamber means, means for sensing air pressure drop across said first and second chamber means, and read-out means responsive to said sensing means operative for diagnostic purposes.

34. A surface sweeping machine particularly adapted to sweeping particulate material under wet or dry conditions comprising a pickup head along which an air stream travels from an air inlet to an air outlet, means for generating said air stream, a hopper, first conduit means for transporting air entrained particulate material from said air outlet to said hopper, second conduit means for transporting air entrained particulate material from said hopper to said air inlet, third conduit means for transporting a portion of the air entrained particulate material from the second conduit means to means for separating the air entrained particulate material portion into a small particle entrained first air stream and a smaller particle entrained second air stream, and fourth conduit means for conducting at least a portion of one of said small particle entrained first air stream and said smaller particle entrained second air stream to said first conduit means.

35. The surface sweeping machine as defined in claim 34 wherein said fourth conduit means conducts at least a portion of said small particle entrained first air stream to said first conduit means.

36. The surface sweeping machine as defined in claim 35 wherein said separating means includes a cyclone separator.

37. The surface sweeping machine as defined in claim 35 wherein said separating means includes a membrane filter.

38. The surface sweeping machine as defined in claim 35 wherein said separating means includes a cyclone separator and a membrane filter.

39. The surface sweeping machine as defined in claim 35 wherein said separating means includes a cyclone separator and a membrane filter, and said membrane filter is located downstream of said cyclone separator.

40. The surface sweeping machine as defined in claim 35 including housing means for housing said separating means, and means for venting said housing means to atmosphere in response to pressure in said housing.

41. The surface sweeping machine as defined in claim 35 including housing means for housing said separating means, and means for venting said housing means to atmosphere in response to pressure differential in said housing.

42. The surface sweeping machine as defined in claim 34 wherein said fourth conduit means conducts at least a portion of said smaller particle entrained second air stream to said first conduit means.

43. The surface sweeping machine as defined in claim 42 wherein said separating means includes a cyclone separator.

44. The surface sweeping machine as defined in claim 42 wherein said separating means includes a membrane filter.

45. The surface sweeping machine as defined in claim 42 wherein said separating means includes a cyclone separator and a membrane filter.

46. The surface sweeping machine as defined in claim 42 wherein said separating means includes a cyclone separator and a membrane filter, and said membrane filter is located downstream of said cyclone separator.

47. The surface sweeping machine as defined in claim 42 including housing means for housing said separating means, and means for venting said housing means to atmosphere in response to pressure in said housing.

48. The surface sweeping machine as defined in claim 42 including housing means for housing said separating means, and means for venting said housing means to atmosphere in response to pressure differential in said housing.

49. The surface sweeping machine as defined in claim 34 wherein said fourth conduit means conducts at least a portion of said small particle entrained first air stream to said first conduit means, and fifth conduit means for conducting at least a portion of said smaller particle entrained second air stream to said first conduit means.

50. The surface sweeping machine as defined in claim 49 wherein said separating means includes a cyclone separator.

51. The surface sweeping machine as defined in claim 49 wherein said separating means includes a membrane filter.

52. The surface sweeping machine as defined in claim 49 wherein said separating means includes a cyclone separator and a membrane filter.

53. The surface sweeping machine as defined in claim 49 wherein said separating means includes a cyclone separator and a membrane filter, and said membrane filter is located downstream of said cyclone separator.

54. The surface sweeping machine as defined in claim 49 including housing means for housing said separating means, and means for venting said housing means to atmosphere in response to pressure in said housing.

55. The surface sweeping machine as defined in claim 49 including housing means for housing said separating means, and means for venting said housing means to atmosphere in response to pressure differential in said housing.

56. The surface sweeping machine as defined in claim 34 wherein said separating means includes a cyclone separator.

57. The surface sweeping machine as defined in claim 34 wherein said separating means includes a membrane filter.

58. The surface sweeping machine as defined in claim 34 wherein said separating means includes a cyclone separator and a membrane filter.

59. The surface sweeping machine as defined in claim 34 wherein said separating means includes a cyclone separator and a membrane filter, and said membrane filter is located downstream of said cyclone separator.

60. The surface sweeping machine as defined in claim 34 including housing means for housing said separating means, and means for venting said housing means to atmosphere in response to pressure in said housing.

61. The surface sweeping machine as defined in claim 34 including housing means for housing said separating means, and means for venting said housing means to atmosphere in response to pressure differential in said housing.

62. The surface sweeping machine as defined in claim 34 including means for sensing pressure drop across said separating means, and means responsive to said pressure drop sensing means for controlling air flow.

63. A surface sweeping machine particularly adapted for sweeping particulate material under wet or dry conditions comprising a pickup head along which an air stream travels from an air inlet to an air outlet, means for generating said air stream, a first hopper, first conduit means for transporting air entrained particulate material from said air outlet to said hopper, second conduit means for transporting air entrained particulate material from said hopper to said air inlet, third conduit means for transporting a portion of the air entrained particulate material from the second conduit means to a second housing, means in said second housing for separating the air entrained particulate material portion into a particle entrained first air stream and a substantially particle free second air stream, said second housing including a first housing portion containing said separating means and a second housing portion into which flows the substantially particle free second air stream, valve means for controlling the flow of the substantially particle free second air stream to atmosphere, and pressure sensing means in said first housing portion to which said valve means is responsive.

64. A surface sweeping machine particularly adapted for sweeping particulate material under wet or dry conditions comprising a pickup head along which an air stream travels from an air inlet to an air outlet, means for generating said air stream, a first hopper, first conduit means for transporting air entrained particulate material from said air outlet to said hopper, second conduit means for transporting air entrained particulate material from said hopper to said air inlet, third conduit means for transporting a portion of the air entrained particulate material from the second conduit means to a second housing, means in said second housing for separating the air entrained particulate material portion into a particle entrained first air stream and a substantially particle free second air stream, said second housing including a first housing portion containing said separating means and a second housing portion into which flows the substantially particle free second air stream, valve means for controlling the flow of the substantially particle free second air stream to atmosphere, and pressure differential sensing means in said first housing portion to which said valve means is responsive.

65. A surface sweeping machine particularly adapted for sweeping particulate material under wet or dry conditions comprising a pickup head along which an air stream travels from an air inlet to an air outlet, means for generating said air stream, a first hopper, first conduit means for transporting air entrained particulate material from said air outlet to said hopper, second conduit means for transporting air entrained particulate material from said hopper to said air inlet, third conduit means for transporting a portion of the air entrained particulate material from the second conduit means to a second housing, means in said second housing for separating the air entrained particulate material portion into a particle entrained first air stream and a substantially particle free second air stream, said second housing including a first housing portion containing said separating means and a second housing portion into which flows the substantially particle free second air stream, valve means for controlling the flow of the substantially particle free second air stream to atmosphere, and pressure differential sensing means in said first housing portion for measuring pressure differential across said separating means to which said valve means is responsive.

66. The surface sweeping machine as defined in claim 63 including means for intermittently cleaning said separating means by impinging thereagainst blasts of substantially high pressure air.

67. The surface sweeping machine as defined in claim 63 wherein said separating means includes at least one cyclone separator.

68. The surface sweeping machine as defined in claim 63 wherein said separating means includes at least one cyclone separator, and said pressure sensing means measures differential pressure across said at least one cyclone separator.

69. The surface sweeping machine as defined in claim 63 wherein said separating means includes at least one cyclone separator upstream of a membrane filter.

70. The surface sweeping machine as defined in claim 63 wherein said separating means includes at least one cyclone separator upstream of a membrane filter, and said pressure sensing means measures differential pressure across said at least one cyclone separator.

71. The surface sweeping machine as defined in claim 70 wherein said at least one cyclone separator separates the air entrained particulate material portion into said particle entrained first air stream containing small particles and a smaller particle entrained second air stream which flows to said membrane filter which creates said substantially particle free second air stream.

72. The surface sweeping machine as defined in claim 71 including fourth conduit means for conducting said small particle entrained first air stream to said first conduit means.

73. The surface sweeping machine as defined in claim 71 including fourth conduit means for conducting said smaller particle entrained second air stream to said first conduit means.

74. The surface sweeping machine as defined in claim 71 including fourth conduit means for conducting said small particle entrained first air stream to said first conduit means, and fifth conduit means for conducting said smaller particle entrained second air stream to said first conduit means.

75. The surface sweeping machine as defined in claim 71 including means for intermittently cleaning said separating means by impinging thereagainst blasts of substantially high pressure air.

76. A surface sweeping machine particularly adapted for sweeping particulate material under wet or dry conditions comprising a pickup head along which an air stream travels from an air inlet to an air outlet, means for generating said air stream, a first hopper, first conduit means for transporting air entrained particulate material from said air outlet to said hopper, second conduit means for transporting air entrained particulate material from said hopper to said air inlet, third conduit means for transporting a portion of the air entrained particulate material from the second conduit means to a second housing, means in said second housing for separating the air entrained particulate material portion into a particle entrained first air stream and a substantially particle free second air stream, said second housing including a first housing portion containing said separating means and a second housing portion into which flows the substantially particle free second air stream, valve means for controlling the flow of the substantially particle free second air stream to atmosphere, and pressure sensing means in said first housing portion to which said valve means is responsive to maintain substantially negative pressure across said pickup head.

77. A surface sweeping machine particularly adapted for sweeping particulate material under wet or dry conditions comprising a pickup head along which an air stream travels from an air inlet to an air outlet, means for generating said air stream, a first hopper, first conduit means for transporting air entrained particulate material from said air outlet to said hopper, second conduit means for transporting air entrained particulate material from said hopper to said air inlet, third conduit means for transporting a portion of the air entrained particulate material from the second conduit means to a second housing, means in said second housing for separating the air entrained particulate material portion into a particle entrained first air stream and a substantially particle free second air stream, said second housing including a first housing portion containing said separating means and a second housing portion into which flows the substantially particle free second air stream, valve means for controlling the flow of the substantially particle free second air stream to atmosphere, and pressure differential sensing means in said first housing portion to which said valve means is responsive to maintain substantially negative pressure across said pickup head.

78. A surface sweeping machine particularly adapted for sweeping particulate material under wet or dry conditions comprising a pickup head along which an air stream travels from an air inlet to an air outlet, means for generating said air stream, a first hopper, first conduit means for transporting air entrained particulate material from said air outlet to said hopper, second conduit means for transporting air entrained particulate material from said hopper to said air inlet, third conduit means for transporting a portion of the air entrained particulate material from the second conduit means to a second housing, means in said second housing for separating the air entrained particulate material portion into a particle entrained first air stream and a substantially particle free second air stream, said second housing including a first housing portion containing said separating means and a second housing portion into which flows the substantially particle free second air stream, valve means for controlling the flow of the substantially particle free second air stream to atmosphere, and pressure differential sensing means in said first housing portion for measuring pressure differential across said separating means to which said valve means is responsive to maintain substantially negative pressure across said pickup head.

* * * * *